United States Patent [19]

Granzow

[11] 4,060,206

[45] Nov. 29, 1977

[54] GRINDING MILL

[76] Inventor: Clarence E. Granzow, 2516 E. Jackson St., Phoenix, Ariz. 85034

[21] Appl. No.: 730,804

[22] Filed: Oct. 8, 1976

[51] Int. Cl.[2] ..... B02C 5/08

[52] U.S. Cl. ..... 241/259.1; 241/248; 241/261.3

[58] Field of Search ..... 241/244, 245, 248, 259.1, 241/259.2, 259.3, 261.2, 261.3

[56] References Cited

U.S. PATENT DOCUMENTS

| | | | |
|---|---|---|---|
| 1,412,026 | 4/1922 | Sturtevant | 241/259.1 |
| 2,959,363 | 11/1960 | Rimmer | 241/259.1 |
| 3,149,792 | 9/1964 | Textor | 241/261.3 |
| 3,371,873 | 3/1968 | Thomas | 241/259.1 |
| 3,638,871 | 2/1972 | Barger | 241/259.1 |
| 3,942,730 | 3/1976 | Coucher | 241/296 |
| 3,960,332 | 6/1976 | Seifert | 241/259.1 |

FOREIGN PATENT DOCUMENTS

| | | | |
|---|---|---|---|
| 280,455 | 1/1952 | Switzerland | 241/259.3 |

*Primary Examiner*—Gerald A. Dost
*Attorney, Agent, or Firm*—Warren F. B. Lindsley

[57] ABSTRACT

A grinding mill for home and commercial use for grinding dry type grains and like material to given consistencies by a pair of disc like grinding and cutting surfaces one pivotally movable relative to the other for cleaning and maintenance purposes.

6 Claims, 15 Drawing Figures

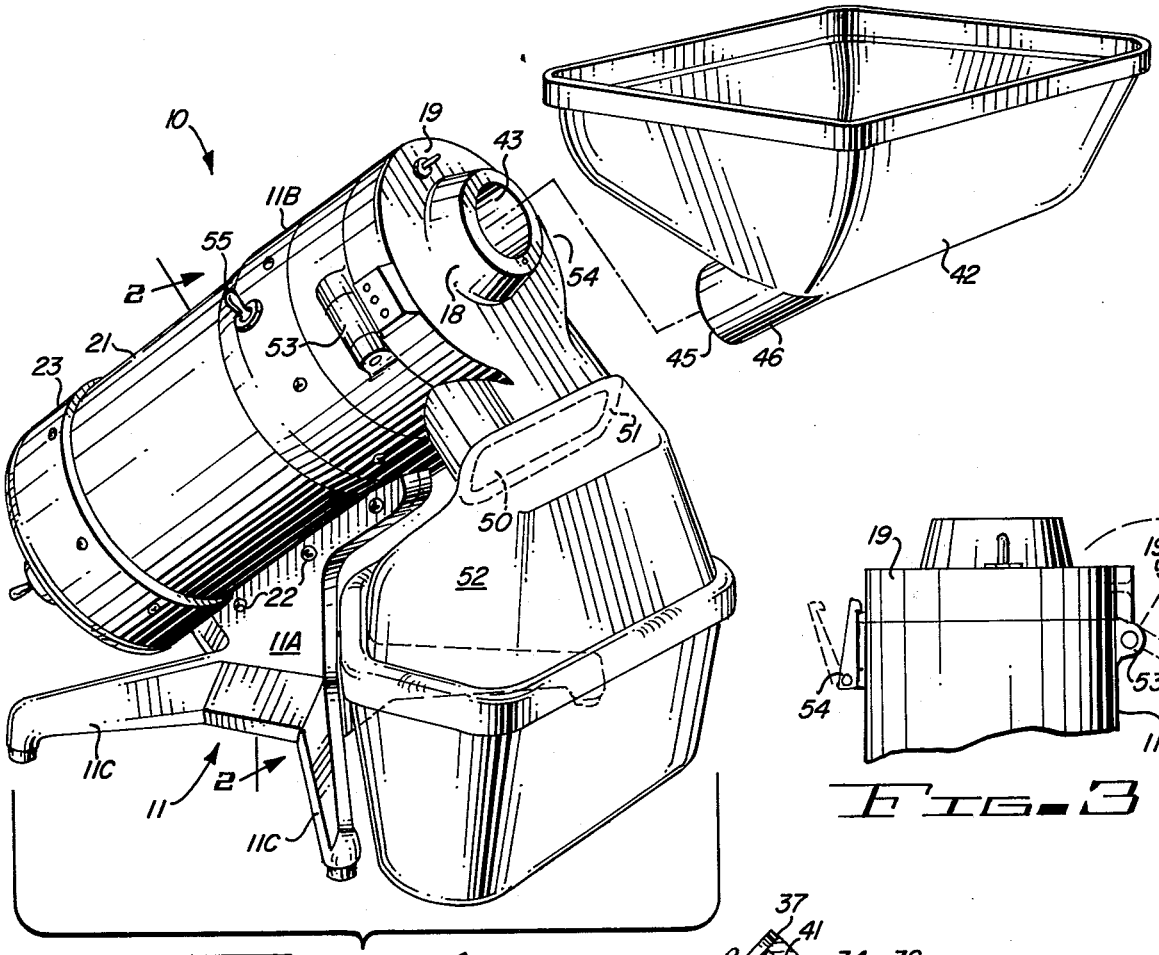
FIG-1
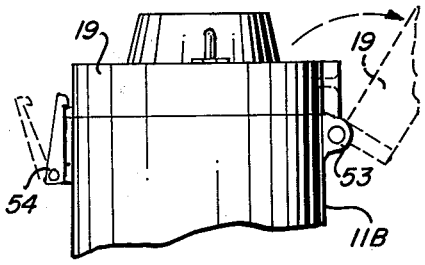
FIG-3
FIG-2
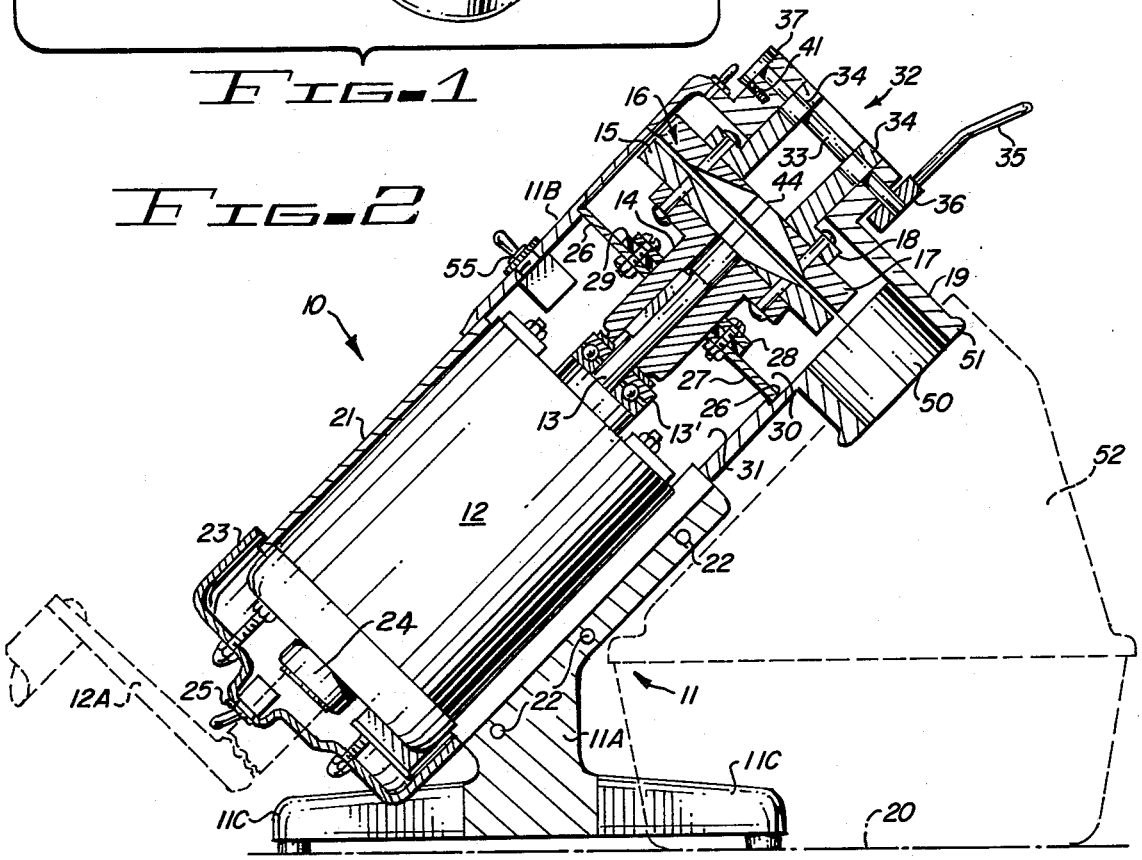

GRINDING MILL

BACKGROUND OF THE INVENTION

Nutrition is the science which deals with the materials which the living organism takes in from its environment, and with the process through which these materials maintain life, promote health and growth, and sustain all the activities of the organism. Food is the source of these nutritive materials and supply all the elements which enter into the structure of the living body to afford the energy for its activities and to regulate the vital processes.

The preparation of food has a great deal to do with its nutritive value and ease and pleasure with which it is consumed and digested, and some changes of the food to make it more palatable destroys its nutritive value.

Seeds and nuts, whether of the tree or ground variety, are of considerable nutritive value and are easily digested if ground into a powder like form of various consistencies.

The demand for seeds, grains, kernels, nuts or the like is constantly growing and with it the desire to prepare various food products directly from raw, natural materials, thereby eliminating the commercial additives objected to by a growing number of people. Since the desire to use grains as a source of protein is increasing, the need for a suitable grinding mill is evident.

1. Field of the Invention

This invention is particularly directed to grinding mills, and more particularly, to a home and commercial appliance which will grind grains and the like to a smooth or course like consistency at the option of the user.

2. Description of the Prior Art

Many types of grinding mills have been provided for home and industry but none have been able in a simple mechanical structure economically manufactured to grind nuts, such as peanuts, walnuts, seed, grains, kernels and the like into a smooth or granular consistency without heat, undue pressure and additives which might destroy the nutritive value of the food products. Further, a need exists for a grinding mill which may be used daily as needed to furnish the ground products without undue loss of time, trouble or substantial nutritive value.

Prior art attempts in home appliances used for milling grains have resulted in an uncontrollable chopping and cutting action which cannot be duplicated repeatedly to obtain the same product consistency.

SUMMARY OF THE INVENTION

It is, therefore, the principle object of this invention to provide an appliance for home or small business use which will readily grind or mill food products such as grains, seeds, kernels and nuts into a smooth or granular controllable consistency. Another object of this invention is to provide a grinding mill for small appliance use which cuts, crushes, grinds, and pulverizes the product into its final consistency without undue generated heat during the milling process.

A further object of this invention is to provide a simple, inexpensive grinding machine for seeds, grains, kernels and nuts which may be used equally well for small or large grinding operations thereby making it possible to store whole grain or seed material indefinitely and mill it only when needed.

A still further object of this invention is to provide an improved grinding mill head which is usable in large or small grinding mill appliances.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which:

FIG. 1 is an exploded perspective view of a grinding mill embodying the invention;

FIG. 2 is a partial cross-sectional view of FIG. 1 taken along the line 2—2;

FIG. 3 is a partial plan view of the right end of the grinding mill shown in FIG. 1 illustrating the hinged cover for the grinding heads;

DESCRIPTION OF THE PREFERRED EMBODIMENT

Figure 4:
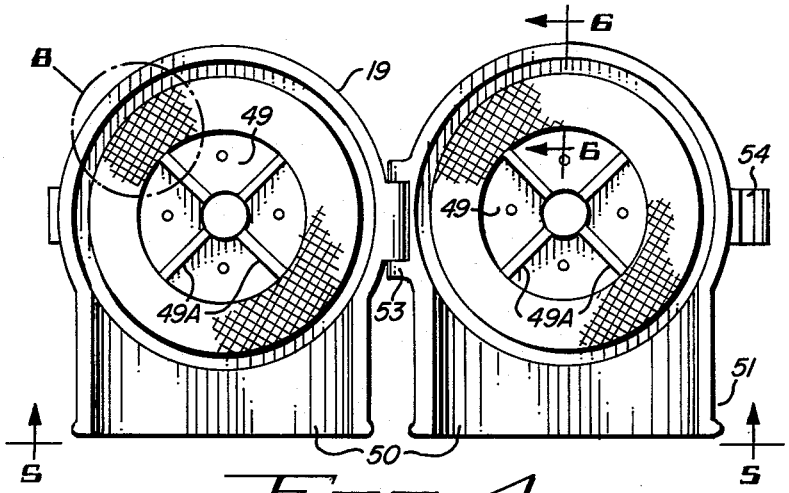
FIG. 4 is a right end view of the grinding mill shown in FIG. 1 with hopper removed and the hinge cover of the grinding head in its open position.

Referring more particularly to the drawings by characters of reference, FIG. 1 discloses an appliance 10 for cutting, grinding and milling seeds, grains, nuts and the like. As shown in Fig. 1, the appliance comprises a housing 11 having a frame portion 11A and a cover portion 11B for a power driving means, such as an electric motor 12 and suitable reduction gear means if needed. The power driving means is coupled to and rotates a rotor 13 to which is fastened by clamping or keying a hub 14 and one plate 15 of a grinding mill head 16. The other juxtapositioned plate 17 of the grinding mill head 16 is clamped to a collar 18 forming a part of hingedly mounted cover 19 for the appliance. As a fail safe feature, a handle 12A is attachable to rotor 13 to rotate manually plate 15 if electric power fails.

The frame portion 11A of housing 11 supports the motor and grinding head in an angular position on a suitable supporting surface such as a table top 20. The power driving means 12 may be enclosed by a band 21 which is held rigid and clamped to and held on frame portion 11A of frame 11 by suitable fasteners such as bolts 22. This band provides a number of functions, namely a fastening means for holding the motor in a desired position without the necessity of machining or drilling into the frame of the motor, a means for decorative material or trim, and a means for dissipating the heat of the motor. A rear cover or safety shield 23 which may be apertured is clamped over the lower end of the power driving means, as shown in FIG. 1 and FIG. 2 to cover and shield the bearing cap 24 of the electric motor and to provide a support and housing for a reversing switch 25 electrically connecting the electric motor to a suitable source of electric power.

The cover portion 11B of housing 11 is provided with a shoulder 26 around its inner periphery which supports an apertured washer, baffel plate or seal retainer 27 to which is clamped a flange 28 formed integral with hub 14. A suitable washer 29 forms a seal for isolating the grinding head and ground material in a portion 30 of cover portion 11B from a portion 31 of cover portion 11B enclosing rotor 13 and thrust bearing 13' and thereby forming a milling chamber in portion 30 of that frame.

Figure 14:
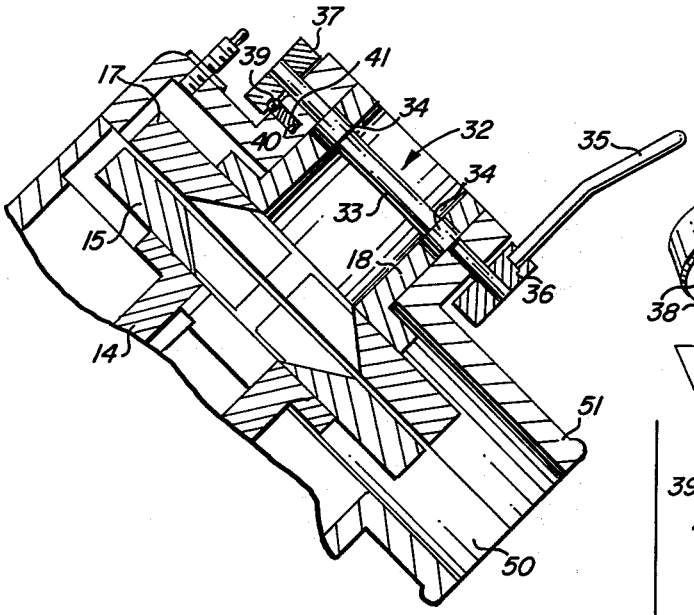
FIG. 14 is an enlarged partial view of FIG. 1 illustrating the grinding plate adjustment means.
Figure 15:
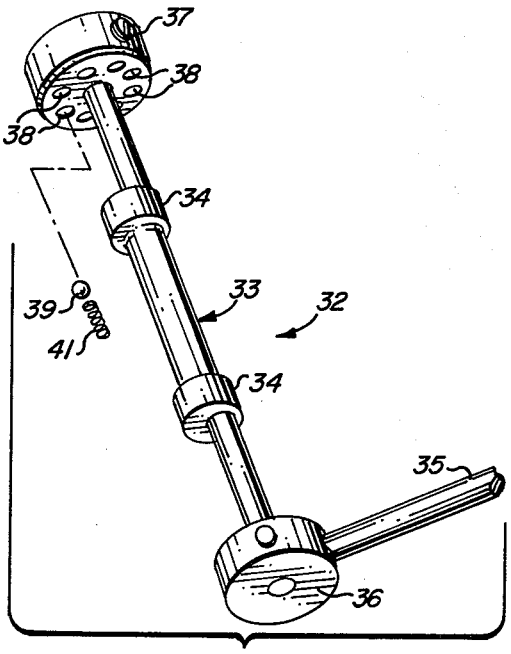
FIG. 15 is an enlarged perspective view of the cam means for selectively positioning the movable plate of the grinding head relative to the stationary plate.

As noted from FIGS. 2, 14 and 15 of the drawings, the plates 15 and 17 of the milling head 16 are adjustably positioned one relative to the other by an adjustment 32 so that the size of the milled product may be selectively controlled.

The adjustment means 32 comprising a cam 33 rotatably mounted on sleeve 18 so that its cam surface 34 bearing against sleeve 18 will move plate 17 of the grinding or milling head 16 relative to plate 15.

Cam 33 may be rotated by a handle 35 attached to a collar 36 fixedly mounted on a cylindrical end of the shaft like structure forming cam 33. The other end of the shaft like structure of the cam 33 is provided with a collar 37, the inside surface of which is provided with a plurality of apertures or indentations 38 arranged in a circle therearound. These indentations are positioned so as to individually engage with a ball bearing 39 or plunger which is urged outwardly of an aperture 40 in housing portion 11B by a spring 41 to hold the adjustment means 32 in a selected position.

The product to be milled is fed by gravity from a hopper 42 through an opening 43 in collar 18 and non-rotating plate 17 into an opening 44 formed coaxially by plates 15 and 17 of the milling head. This grain hopper is attached to cover portion 11B by locating an opening 45 in a boss 46 on the hopper in opening 3 in collar 18 and into a suitable feed hole of the non-rotating plate 17. Fastening means employing a suitable thumb screw or other means may be used for fastening the hopper to collar 18 if so desired.

Figure 6:
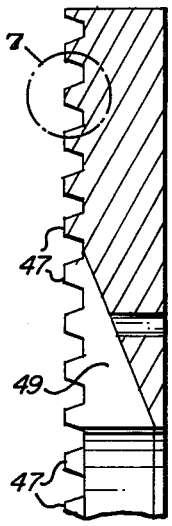
FIG. 6 is a cross-sectional view of FIG. 4 taken along the line 6—6.
Figure 8:
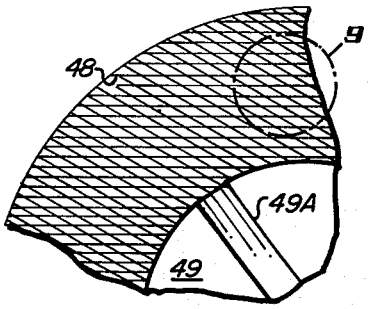
FIG. 8 is an enlarged view of the circled area 8 in FIG. 4.
Figure 9:
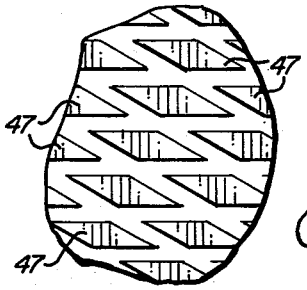
FIG. 9 is an enlarged plane view of a portion of the grinding surface of the grinding head of the mill shown in FIG. 1.
Figure 7:
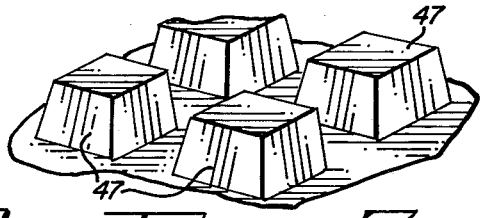
FIG. 7 is an enlarged perspective view of a plurality of teeth of the grinding head at the circled area 7 in FIG. 6.

Although the juxtapositioned cutting and grinding surfaces of plates 15 and 17 of the grinding head 16 may have any suitable tooth configuration, they should be such as to permit movement one relative to the other in clockwise or counter-clockwise rotation. FIGS. 6–9 illustrate various grinding surfaces of the plates of the milling heads. FIGS. 6 and 7 illustrate that the teeth of the plates of the milling head may be formed as a frustrum 47 of a cone arranged in a circular band or track 48 around a cutting concave indentation 49. It should be noted that the radially extending arms 49A bridging the concave indentation 49 perform the initial chopping or cutting action of the milling head. After the initial cutting and chopping action, the grain like material is centrifugally forced into and between and through the teeth of the outer peripheral surface of the grinding and milling plates 15 and 17 wherein the material is grounded or milled to its chosen consistency. FIGS. 8 and 9 illustrate the teeth in a repetitive pattern along the outer peripheral milling surfaces of the plates of the mill head.

As the raw material is fed into opening 43 of the non-rotating plate 17 and into a hollow opening 44 between plates 15 and 17 of the milling head and the plates are located one relative to the other, the material is chopped or cut, ground and milled into selected predetermined sizes and through the action of centrifugal force and gravity are discharged through an opening 50 in collar 51 of housing portion 11B into a molded container 52 or bag (not shown). As noted from the drawing, frame portion 11A is formed to provide four spaced feet 11C, two of which provide a nest directly under the cover portion 11B and opening 50 for receiving and securing the base of container 52 during a milling operation.

Figure 5:
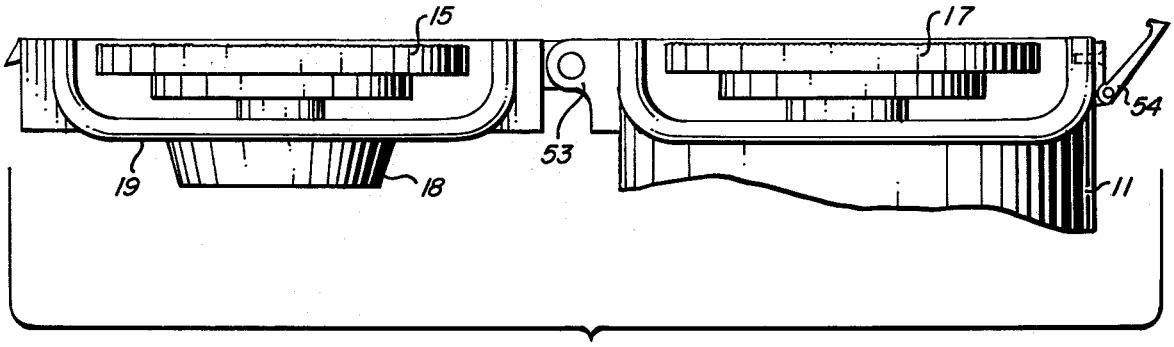
FIG. 5 is a view of FIG. 4 taken along the line 5—5.

To expedite the cleaning or replacement of the plates of the milling head, cover 19 is hingedly fastened at 53 to cover portion 11B. Thus, upon rotation of cover 19 relative to cover portion 11B as shown in FIGS. 4 and 5, the plates 15 and 17 of the milling head are separated one from the other. When pivoted back into place, as shown in FIGS. 1 and 2, cover 19 is fastened to cover portion 11B by a suitable clamp or latch 54 engaging with and locking to a catch (not shown) on the cover portion.

It should be noted that an electric current on-off switch 55 may be mounted on cover portion 11B as shown in FIG. 2 for connecting motor 12 to a source of electric power. By reversing the rotation of the milling head grinding members one relative to the other in clockwise and counterclockwise direction, the cutting and grinding teeth on their surfaces may be maintained sharp, effective and assist in self cleaning.

FIGS. 10–13 illustrate further modification of the cutting and grinding surfaces of the plates 15 and 17. Although the plates shown have been identified as plate 17, they also represent the plate configuration for plate 15.

Figure 10:
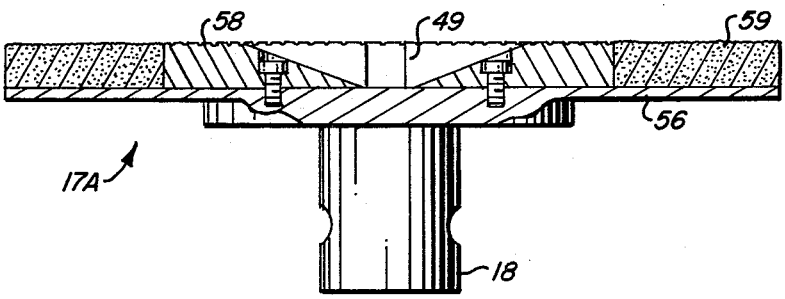
FIG. 10 is a cross-sectional view of a modification of the grinding head shown in FIG. 4 wherein the cutting and grinding surface of the grinding head comprises steel and carborundum portions.
Figure 12:
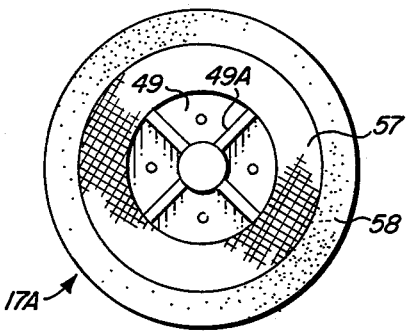
FIG. 12 is a top view of FIG. 10.

FIGS. 10 and 12 illustrate a plate configuration 17A wherein the cutting surfaces of the plate are mounted on a supporting surface 56 forming a part of the collar 18 of cover 19. The cutting and grinding surface comprises a first area 58 circular in configuration having a plurality of metallic, such as steel, cutting teeth and a radially juxtapositioned second area 59 forming a ring of a suitable grinding material such as, for example, carborundum. All other like parts of the cutting head are provided with the same reference characters.

Figure 11:
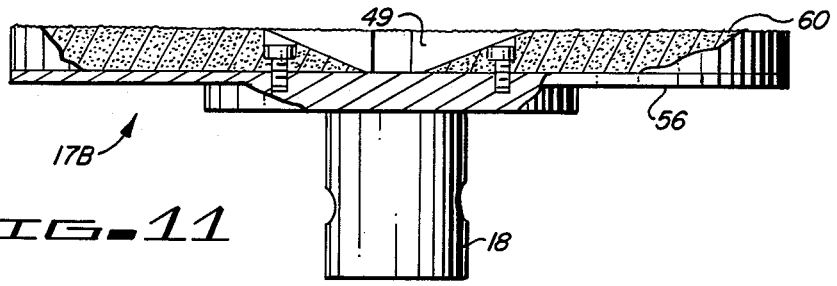
FIG. 11 is a cross-sectional view of a further modification of the grinding heads shown in FIGS. 4 and 10 wherein the cutting and grinding surface of the grinding head comprises a stone like material such as carborundum.
Figure 13:
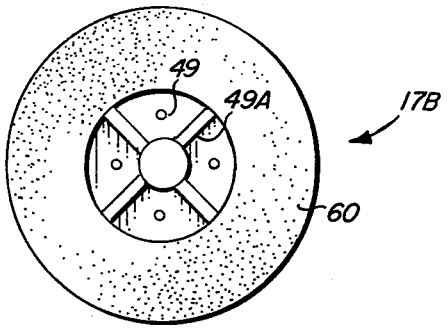
FIG. 13 is a top view of FIG. 11.

FIGS. 11 and 13 illustrate a further modification of the cutting and grinding surfaces of the plates of 15 and 17 wherein the cutting head 17B comprises a supporting surface 56 forming a part of the collar 18 of cover 19. The cutting and grinding surface comprises a circular area 60 formed of a suitable grinding material such as, for example, carborundum.

Although but one embodiment of the present invention has been illustrated and described, it will be apparent to those skilled in the art that various changes and modifications may be made therein without departing from the spirit of the invention or from the scope of the appended claims.

What is claimed is:

1. A grinding mill for seeds, nuts, grains and like materials comprising in combination:

a frame having a base portion and a cover portion, said cover portion having a pivotally mounted cover for exposing and concealing the inside of said cover portion, motor means comprising a rotating shaft mounted on said base portion of said frame, a milling head comprising a pair of relatively movable disc type cutting and grinding members juxtapositioned in coplanar arrangement when in a grinding and milling operation within said cover portion, one of said members being mounted on said shaft for rotation therewith and the other of said members being mounted on said cover for pivotal movement therewith from a position juxtapositioned to said one member to a position spaced therefrom for exposing said one member, said cover being provided with an aperture extending therethrough for alignment with an aperture extending through said other member into a space between said members, a collar surrounding said aperture in said cover, a hopper mountable on said cover and having a discharge passage leading into said aperture of said cover, and said hopper being detachably mounted on said collar surrounding said aperture in said cover, said cover portion comprising a milling chamber housing said milling head and defining an outlet port for discharging the ground and milled products, and an adjustment means for axially positioning one of said grinding members relative to the other for controlling the condition of the milled product, said adjustment means comprises a cam rotatably mounted on said cover, said frame supporting said motor and rotating shaft at an acute angle with a supporting surface of the grinding mill with the longitudinal axis of said outlet port of said milling chamber being substantially perpendicular to the axis of said rotating shaft.

2. The grinding mill set forth in claim 1 wherein:

said cover and said other of said members of said milling head are pivotally movable to a position wherein the grinding surface of said members of said milling head are coplanar.

3. The grinding mill set forth in claim 1 wherein:

the grinding and milling surface of each of said members of said milling head comprises a circular band around an indented non grinding and milling portion, said circular band comprising two circular portions one comprising a tooth cutting portion and the other a carborundum grinding portion.

4. The grinding mill set forth in claim 3 wherein:

said stone like portion is juxtapositioned radially outwardly from said tooth portion.

5. The grinding mill set forth in claim 1 wherein:

said member mounted on said cover is stationary during a milling operation.

6. The grinding mill set forth in claim 1 in further combination with:

a reversing switch mounted on said frame for connecting said motor to a source of power, whereby the movement of said members may be reversed to maintain teeth on their grinding and milling surfaces sharp.

* * * * *